US006000589A

United States Patent [19]

Burdine

[11] Patent Number: 6,000,589

[45] **Date of Patent: *Dec. 14, 1999**

[54] AUTOMATIC CLIP HOLDER

[76] Inventor: John M. Burdine, 4300 Canaan Creek Rd., Edmond, Okla. 73034

[ * ] Notice: Under 35 U.S.C. 154(b), the term of this patent shall be extended for 156 days.

[21] Appl. No.: 08/545,920

[22] Filed: Oct. 20, 1995

[51] Int. Cl.[6] ..... B65D 83/00; B65G 59/02; F42B 39/26

[52] U.S. Cl. ..... 224/196; 224/666; 224/679; 224/931; 221/185; 221/279

[58] Field of Search ..... 224/196, 931, 224/239, 679, 666; 221/185, 279

[56] References Cited

U.S. PATENT DOCUMENTS

| | | | |
|---|---|---|---|
| 162,481 | 4/1875 | Lee | 221/185 |
| 900,819 | 10/1908 | Aylsworth | 221/185 |
| 2,779,522 | 1/1957 | Puckett | 221/185 |
| 3,219,244 | 11/1965 | Blask | 221/185 |
| 3,927,809 | 12/1975 | Klein, Sr. | 224/196 |
| 4,465,208 | 8/1984 | Buban et al. | 221/279 |
| 5,337,897 | 8/1994 | Yablans | 221/279 |

*Primary Examiner*—Linda J. Sholl
*Attorney, Agent, or Firm*—McAfee & Taft

[57] ABSTRACT

A clip carrier for storing and dispensing semi-automatic cartridge clips which consists of a generally rectangular container having opposite sides, opposite edges and a bottom panel with upper edge flanges that define a longitudinal groove. A cartridge clip sized opening is formed in one edge panel for entry of a cartridge clip to be forced downward against a spring-loaded push plate. A plurality of such cartridge clips can be entered and forced downward until the carrier container reaches capacity.

3 Claims, 1 Drawing Sheet

AUTOMATIC CLIP HOLDER

BACKGROUND OF THE INVENTION

1. Field of the Invention

The invention relates generally to an automatic weapon ammunition dispenser and, more particularly, but not by way of limitation, it relates to a spring-loaded automatic clip holder for rapid dispensing of ammunition clips.

2. Description of the Prior Art

The prior art includes numerous types of cartridge or bullet dispensers as exemplified by U.S. Pat. No. 2,902,196 wherein individual cartridges are loaded into a magazine and dispensed under the force from an internal spring. Another device of interest is the magazine holster as disclosed in U.S. Pat. No. 5,174,482 wherein one or more holster device may be carried on a user's belt to hold individual magazines as used by an automatic pistol or the like. No prior art was encountered for the dispensing of a plurality of automatic gun magazines as disclosed in the present application.

SUMMARY OF THE INVENTION

The present invention relates to a clip carrier that may be carried on the user's belt in ready position. The clip carrier consists of a generally rectangular-formed metal box having a cross section which is the general size of an automatic gun clip. The clip carrier has a spring member secured to the bottom panel to continually urge a push plate upward toward a dispensing slideway at the top of the clip carrier. The clip is designed to hold a plurality of semi-automatic cartridge clips in stacked array as they are inserted at the top and loaded downward against the spring tension within the clip carrier. A belt clip or other securing device may be utilized with the clip carrier.

Therefore, it is an object of the present invention to provide a carrier device for rapid dispensing of semi-automatic cartridge clips.

It is also an object of the present invention to provide a clip carrier to be secured on the belt thereby to enable rapid accessibility to the user.

It is yet further an object of the present invention to provide a carrier for easily dispensing up to five fully loaded semi-automatic cartridge clips.

Finally, it is an object of the present invention to provide a cartridge clip dispenser that is secure and reliable in operation.

Other objects and advantages of the invention will be evident from the following detailed description when read in conjunction with the accompanying drawings that illustrate the invention.

DETAILED DESCRIPTION OF THE INVENTION

Figure 1:
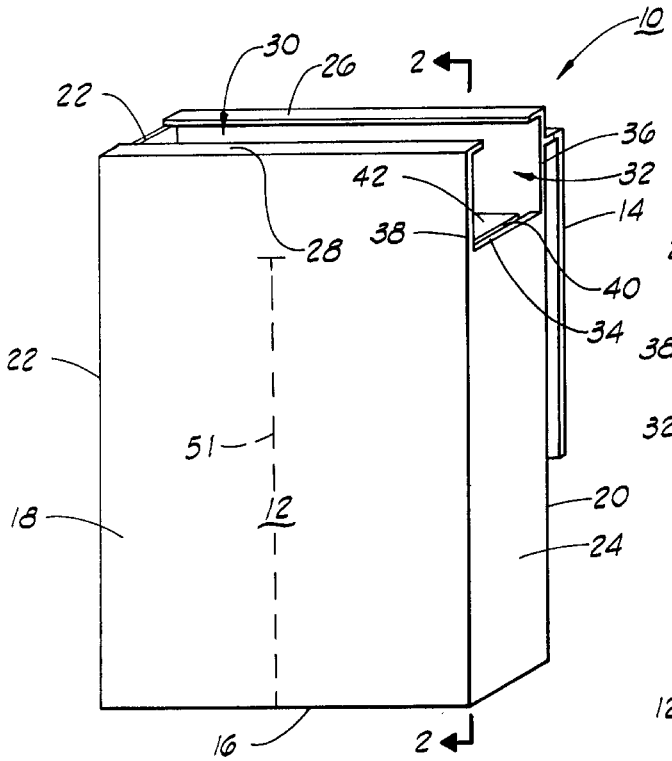
FIG. 1 is a perspective view of the front side of the clip carrier.

Referring to FIG. 1, the clip carrier 10 is preferably constructed from suitable rigid substance in the form of a container 12 having a belt clip 14 integrally formed thereon.

The container 12 is a square cornered formation having a bottom panel 16, broad front and rear panels 18 and 20, and narrower side panels 22 and 24. The top portion of container 12 front and rear panels 18 and 20 have folded corners which form parallel tabs 26 and 28 that define an elongate slot 30 extending lengthwise along the top of container 12.

The top of one edge panel 24 of container 12 is formed with a rectangular opening 32 that is approximately the size of the cross section of a semi-automatic cartridge clip. Thus, entry opening 32 serves as the opening for loading cartridge clips into the container 12 prior to use during shooting exercise. Opening 32 is formed by upper edge 34 of side panel 24 and the adjacent upper sidewalls 36 and 38. An interior clearance 40 adjacent upper edge 34 functions to accommodate the rim of the cartridge clips.

Figure 2:
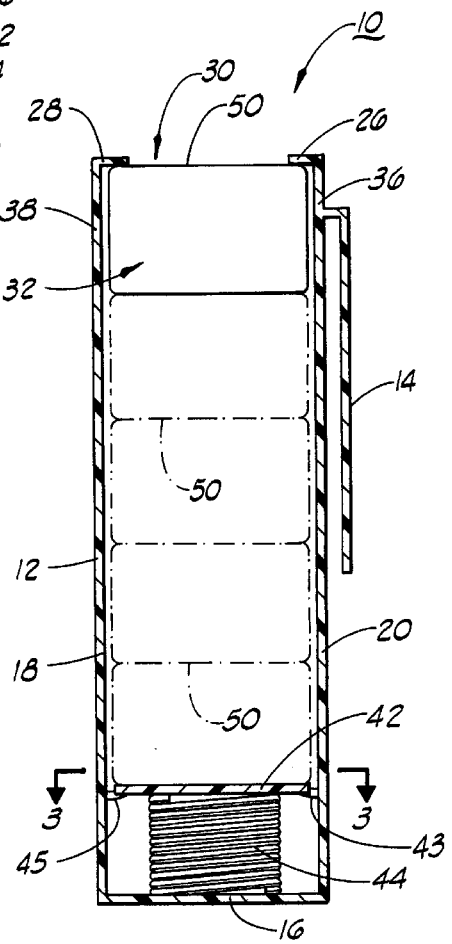
FIG. 2 is a vertical cross section taken along lines 2—2 of FIG. 1.
Figure 3:
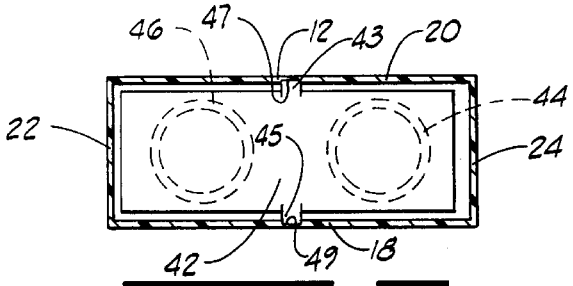
FIG. 3 is a horizontal cross section taken along lines 3—3 of FIG. 2.

The sectional view of FIG. 2 illustrates the interior of container 12 with the rectangular push plate 42 in the downward position with springs 44 and 46 totally compressed. Referring also to FIG. 3, the push plate 42 includes opposite side alignment tongs 43 and 45 which ride in respective slots 47 and 49 formed in the inside of side panels 20 and 18. Dash line 51 (FIG. 1) illustrates the upward extent of slots 47 and 49. The push plate 42 is placed in its lowest position when the full capacity of cartridge clips 50 has been loaded into the container 12. FIG. 2 shows five such cartridge clips 50 that have been loaded into container 12 by inserting each through entry opening 32 (FIG. 1) and depressing to enable entry of the next succeeding cartridge clip 50. In this case, five cartridge clips 50 constitute the full capacity although different sizes of cartridge clips may be accommodated in varying numbers depending on the size of the container 12.

In operation, the user loads the clip carrier 10 by inserting up to five cartridge clips 50 one at a time through the side entry opening 32. A cartridge clip 50 is inserted to slide totally within the upper extremities of container 12 whereupon it can be manually depressed through slot 30 to receive a next successive cartridge clip 50 through the entry opening 32. This proceeds until (in this case) five full cartridge clips 50 have been received into entry opening 32 and depressed downward until the full complement of cartridge clips 50 is forced downward against the push plate 42 and springs 44 and 46, as shown in FIG. 2. The operator or shootist is then ready to insert the belt clip 14 over his belt and proceed to the designated field or target range.

To load a semi-automatic gun, the operator need only push a cartridge clip 50 out through opening 32 by use of thumb movement along guide slot 30 whereupon the cartridge clip 50 can be inserted in the weapon and it is discharge ready. This may occur for up to five cartridge clips 50 whereupon new cartridge clips 50 must be inserted into the clip carrier 10, or the original cartridge clips 50 may be reloaded with cartridges and then re-entered into the clip carrier 10.

The foregoing discloses a novel semi-automatic cartridge clip carrier that may be carried in an accessible position to dispense full cartridge clips quickly for insertion in a weapon. A plurality of such cartridge clips may be placed in spring-loaded stowage for individual sliding extraction thereby to enable a large volume of rapidly accessible fire power. Clip carriers constructed in accordance with the present invention contribute to greater gun safety through orderly storage and handling of ammunition.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A clip carrier for semi-automatic cartridge clips comprising:

a container having opposite side panels, opposite edge panels and a bottom panel with top part of one edge panel forming an entry opening for receiving and dispensing a cartridge clip therethrough, said entry opening being similar in size and configuration to said cartridge clip;

first and second flanges folded inwardly along the upper edge of respective opposite side panels to define an access groove therebetween;

spring means within said container secured to the bottom panel and urging upward; and a rectangular push plate disposed transversely across said container and supported by said compression spring means for reciprocal movement within said container to urge cartridge clips toward said first and second flanges adjacent said entry opening.

2. A clip carrier as set forth in claim 1 which further includes:

a belt clip securing adjacent the top of one side panel and extending downward.

3. A clip carrier as set forth in claim 1 wherein said spring means comprises:

first and second compression springs each having one end secured to opposite sides of the bottom panel and the opposite end secured to opposite sides of said push plate.

* * * * *